US009371161B2

(12) United States Patent
Rudy

(10) Patent No.: US 9,371,161 B2
(45) Date of Patent: Jun. 21, 2016

(54) UNIVERSAL CAP SEAL FOR FIFTY-FIVE GALLON DRUMS

(71) Applicant: Barrel Accessories & Supplies Co., Inc., University Park, IL (US)

(72) Inventor: Richard Rudy, Flossmoor, IL (US)

(73) Assignee: Barrel Associates & Supplies Co., Inc., University Park, IL (US)

( * ) Notice: Subject to any disclaimer, the term of this patent is extended or adjusted under 35 U.S.C. 154(b) by 30 days.

(21) Appl. No.: 14/463,839

(22) Filed: Aug. 20, 2014

(65) Prior Publication Data

US 2016/0052679 A1 Feb. 25, 2016

(51) Int. Cl.

| | |
|---|---|
| ***B65D 17/32*** | (2006.01) |
| ***B65D 41/16*** | (2006.01) |
| ***B65D 41/48*** | (2006.01) |
| ***B65D 51/18*** | (2006.01) |
| *B65D 43/10* | (2006.01) |

(52) U.S. Cl.

CPC ..... *B65D 41/16* (2013.01); *B65D 41/48* (2013.01); *B65D 51/18* (2013.01); *B65D 2251/0015* (2013.01)

(58) Field of Classification Search

CPC .. B65D 17/161; B65D 17/163; B65D 17/165; B65D 43/00754; B65D 2543/00805; B65D 2543/00851; B65D 41/16; B65D 41/48; B65D 51/18; B65D 2251/0015

USPC ..... 220/266, 268, 805, 784, 270

See application file for complete search history.

(56) References Cited

U.S. PATENT DOCUMENTS

| | | | | |
|---|---|---|---|---|
| 2,156,540 | A | 5/1939 | Melrath | |
| 3,465,906 | A * | 9/1969 | Wagner | B65D 51/243 215/253 |
| 3,987,929 | A | 10/1976 | Mineo | |
| 4,091,960 | A | 5/1978 | Stoll, III | |
| 4,387,818 | A * | 6/1983 | Conti | B65D 41/485 215/256 |
| 4,738,376 | A | 4/1988 | Markus | |
| 5,096,077 | A * | 3/1992 | Odet | B65D 47/0838 215/211 |
| 5,320,237 | A | 6/1994 | Stolzman | |
| 5,660,302 | A | 8/1997 | Trout | |
| 5,950,851 | A * | 9/1999 | Clodfelter | B65D 50/046 215/334 |
| 5,996,833 | A * | 12/1999 | Lencioni | B65D 41/62 215/251 |
| 6,065,627 | A | 5/2000 | Johanson | |

(Continued)

FOREIGN PATENT DOCUMENTS

| | | |
|---|---|---|
| DE | 19831192 | 2/1999 |
| GB | 728880 | 4/1955 |

(Continued)

*Primary Examiner* — J. Gregory Pickett
*Assistant Examiner* — Niki M Eloshway
(74) *Attorney, Agent, or Firm* — Mercedes V. O'Connor; Howard B. Rockman

(57) ABSTRACT

A universal cap seal for fifty-five gallon drums designed to fit over bung flanges and rims in drums of varying size and varying height. The universal cap seal comprises a body having a flat upper surface and an internal surface. The flat upper surface of the body includes a channel that holds a tamper evident lifting band. The lifting band has a lifting tab that enables the user to remove the cap seal from the flange. A sidewall extends from the flat upper surface. A shield extends downwardly from the sidewall and includes a plurality of individual pivotal segments separated by a plurality of slits. The internal surface of the body includes at least two downwardly extending internal snap elements that frictionally engage an outer portion of the flange.

11 Claims, 5 Drawing Sheets

(56) References Cited

U.S. PATENT DOCUMENTS

| | | | | |
|---|---|---|---|---|
| 6,360,908 | B1 | 3/2002 | Kline | |
| 6,681,947 | B2 * | 1/2004 | Kim | B65D 41/48 215/253 |
| 6,726,048 | B2 | 4/2004 | Dwinell et al. | |
| 6,854,616 | B2 * | 2/2005 | Steffan | B65D 59/06 215/254 |
| 7,080,749 | B2 | 7/2006 | Van Bruggen | |
| 7,222,741 | B2 | 5/2007 | Chmela et al. | |
| 7,568,585 | B2 | 8/2009 | Baughman et al. | |
| 7,690,526 | B1 | 4/2010 | Hoff | |
| 7,690,527 | B2 | 4/2010 | Englund | |
| 7,931,167 | B2 * | 4/2011 | Chmela | B65D 41/48 215/253 |
| 8,371,463 | B2 * | 2/2013 | Beecroft | B65D 50/046 215/216 |
| 8,453,867 | B2 | 6/2013 | Van De Klippe et al. | |
| 8,783,483 | B2 * | 7/2014 | Faragher | B65D 47/0838 215/216 |
| 2004/0144786 | A1 * | 7/2004 | Chmela | B65D 55/024 220/257.1 |
| 2008/0084063 | A1 | 4/2008 | Hamilton | |
| 2010/0301046 | A1 | 12/2010 | Schuetz | |

FOREIGN PATENT DOCUMENTS

| | | |
|---|---|---|
| GB | 989473 | 4/1965 |
| WO | 2010068986 | 6/2010 |

* cited by examiner

UNIVERSAL CAP SEAL FOR FIFTY-FIVE GALLON DRUMS

BACKGROUND OF THE INVENTION

1. Field of the Invention

The present invention relates to a cap seal for fifty-five gallon drums, and more particularly, to a universal cap seal designed to fit over bung flanges and rims in drums made by different drum manufacturers, with varying size and varying height bung flanges.

2. Description of the Prior Art

Fifty-five gallon drums normally have a filling and emptying aperture on the top or side of the drum. The aperture is surrounded by a raised circular flange forming a rim extending outward from and surrounding the aperture, the combination referred to as a "bung." Different drum manufacturers produce varying sized bung flanges and rims in the drums they manufacture. The universal cap seal of the present invention is designed to fit over any size bung flange and rim of varying drums.

U.S. Patent '929 discloses a cap seal for a drum that is made of material having some elasticity and that includes a circular top wall, a peripheral wall and an inward annular projection formed on the inner surface of the peripheral wall and engageable with an outwardly projecting edge at the upper end of a mouthpiece of a drum. Patent '929 does not disclose a plurality of centering studs to engage the upper rim of the flange and does not disclose a downwardly extending shield which is divided into a plurality of individual pivotal segments. The '929 patent does not disclose a capseal that could accommodate different height flange/plug systems.

U.S. Patent '908 discloses a tamper-evident drum closure overcap that includes a cap, a removable skirt, and a plurality of spaced-apart frangible elements which connect the removable skirt to the cap. The cap portion of the overcap includes a depending sidewall which terminates in a snap-on lip portion. The actual snap-on engagement of the cap to the closure assembly involves engagement by the lip portion with a cooperating edge of the closure assembly. In order to gain access to an edge of the cap in order to pry the cap off of the closure assembly, the skirt must be removed by severing the spaced-apart frangible elements. Patent '908 does not disclose a plurality of centering studs 30 that engage the upper rim of flange "B" and does not disclose a downwardly extending shield which is divided into a plurality of individual pivotal segments by slits. The '908 patent does not disclose a capseal that could accommodate different height flange/plug systems.

U.S. Patent '048 discloses a plastic tamper evident overseal that completely covers the plug and neck and is manually snapped in place so as to interlockingly engage the plug making both the plug wrench engaging structure and the overseal interlocking structure inaccessible without destruction of the overseal. The overseal in patent '048 includes a series of axially elongated leg segments with segment feet that engage lug grooves in the interior of the plug. Patent '048 does not disclose a plurality of centering studs that engage the upper rim of the flange and does not disclose a downwardly extending shield which is divided into a plurality of individual pivotal segments by slits. The '048 patent does not disclose a capseal that could accommodate different height flange/plug systems.

U.S. Patent '749 discloses a drum closure overcap that includes a depending skirt and an annular locking bead and consists of a snap-on cap surrounded by a frangibly connected tamper detecting band. The band is joined to a tear strip formed in the cap so as to enable destructive removal of the cap from the closure using the tamper detecting band as a ring pull member. Patent '749 does not disclose a plurality of centering studs that engage the upper rim of a flange. The '749 patent also does not disclose a capseal that could accommodate different height flange/plug systems.

U.S. Patent '741discloses a tamper evident cover that includes an annular sidewall and a series of locking projections or teeth descending downwardly from the lower edge of the sidewall. The series of locking teeth includes a series of downwardly projecting tabs. The locking teeth and tabs are used to engage and snap over the lip of the container. Patent '741 does not disclose a plurality of centering studs that engage the upper rim of the flange and does not disclose a downwardly extending shield which is divided into a plurality of individual pivotal segments by slits. The '741 patent does not disclose a capseal that could accommodate different height flange/plug systems.

U.S. Patent '585 discloses a snap-on capseal that includes an annular sidewall, a generally circular top panel joined to the sidewall, a snap-on annular rim formed adjacent a lower edge of the sidewall, and an annular sealing lip formed adjacent the annular rim. The sealing lip extends radially outwardly from the sidewall and includes a concave surface facing the container end for sealing off the interior portions of the closure from collecting debris. Patent '585 does not disclose a plurality of centering studs that engage the upper rim of the flange and does not disclose a downwardly extending shield which is divided into a plurality of individual pivotal segments by slits. The '585 patent does not disclose a capseal that could accommodate different height flange/plug systems.

German Patent DE '192 discloses a cap that includes a flat cover-plate from which at least one cap-shaped outer flange, with inner cap projections that snap-fit over a bunghole neck, extends at right angles. Patent '192 does not disclose a plurality of centering studs that engage the upper rim of the flange and does not disclose a downwardly extending shield which is divided into a plurality of individual pivotal segments by slits. The '192 patent does not disclose a capseal that could accommodate different height flange/plug systems.

Great Britain Patent GB '473 discloses a lid for a container that includes a skirt portion adapted to surround the rim of a container wherein a plurality of inwardly projecting fins are provided on the inside of the skirt portion to engage the rim of the container, the fins being free to flex towards the skirt portion. The lid in Patent '473 is able to accommodate containers of varying diameters or containers that are distorted. The lid is retained on the container by radial forces exerted on the container rim by the fins which are placed under tension when deflected by fitting over the rim. Although the lid disclosed in Patent No. '473 could accommodate different height flange/plug systems, patent '473 does not disclose a plurality of centering studs that engage the upper rim of a flange and does not disclose a downwardly extending shield which is divided into a plurality of individual pivotal segments by slits. The lid in Patent '473 accomplishes somewhat similar results, but uses a different structure to accomplish these results.

The prior art to date does not disclose a universal cap seal for fifty-five gallon drums that is designed to fit over bung flanges and rims in drums made by different drum manufacturers, with varying sized bung flanges. None of the prior art can be combined in a way to suggest the necessary modifications to produce a universal cap seal. There is no teaching, suggestion, or motivation that would have enabled a person of ordinary skill in the art to modify any prior art cap seal or bung plug in the manner embodied in the present invention.

It is a primary object of the present invention to provide a universal cap seal for fifty-five gallon drums that is designed to fit over bung flanges and rims in drums made by different drum manufacturers, with varying sized/height bung flanges, to seal the bung flange so that it will be evident if the cap seal is tampered with.

Another object of the present invention is to provide a universal cap seal for fifty-five gallon drums that includes a downwardly extending shield comprised of a plurality of individual pivotal segments that angle outwardly approximately thirty degrees to allow the cap seal to fit over a variety of raised rim bung shapes. The downwardly extending shield segments also provide an upward force to the cap seal to urge the cap seal into its locking position.

Still another object of the present invention is to provide a universal cap seal for fifty-five gallon drums that includes at least two internal snap elements, of approximately 130 degrees, that frictionally engage an outer portion of the flange.

SUMMARY OF THE INVENTION

The universal cap seal for fifty-five gallon drums of the present invention is designed to frictionally engage the flange located on the entrance port that communicates with the interior of the fifty-five gallon drum. The entrance port is defined by the flange attached to the outer portion of the fifty-five gallon drum. The universal cap seal comprises a body having a flat upper surface and an internal surface. A sidewall extends from the flat upper surface. A shield extends downwardly from the sidewall and includes a plurality of individual pivotal segments separated by a plurality of slits. The internal surface of the body includes at least two downwardly extending internal snap elements that frictionally engage an outer portion of the flange. The flat upper surface of the body includes a channel that holds a lifting band. The lifting band has a lifting tab that enables the user to remove the cap seal from the flange.

In an embodiment, the internal snap elements each further include at least one integrally formed continuous snap protrusion that engages the outer portion of the flange. The snap protrusions are triangular in cross section and are at approximately 130 degrees.

BRIEF DESCRIPTION OF THE DRAWINGS

The present invention is further described with reference to the accompanying drawings in which.

DETAILED DESCRIPTION OF THE ILLUSTRATED EMBODIMENT

Fifty-five gallon drums normally have a filling and emptying aperture on the top or side of the drum. The aperture is surrounded by a raised circular flange forming an upstanding rim portion extending outward from the surrounding aperture. The upstanding rim portion forms the aperture communicating with the interior portion of the drum. The aperture and rim portion, the combination of the two often referred to as a "bung," may also be located on a side outside portion of the container. A flange is rigidly attached to a flat portion of the drum around an opening in the drum, such as by welding, brazing, or like attachment processes as are known in the art. The flange in normal use on existing drum containers has an upstanding rim portion attached at the top of a curved flange portion, and a side wall portion extending circumferentially around the flange.

Figure 1:
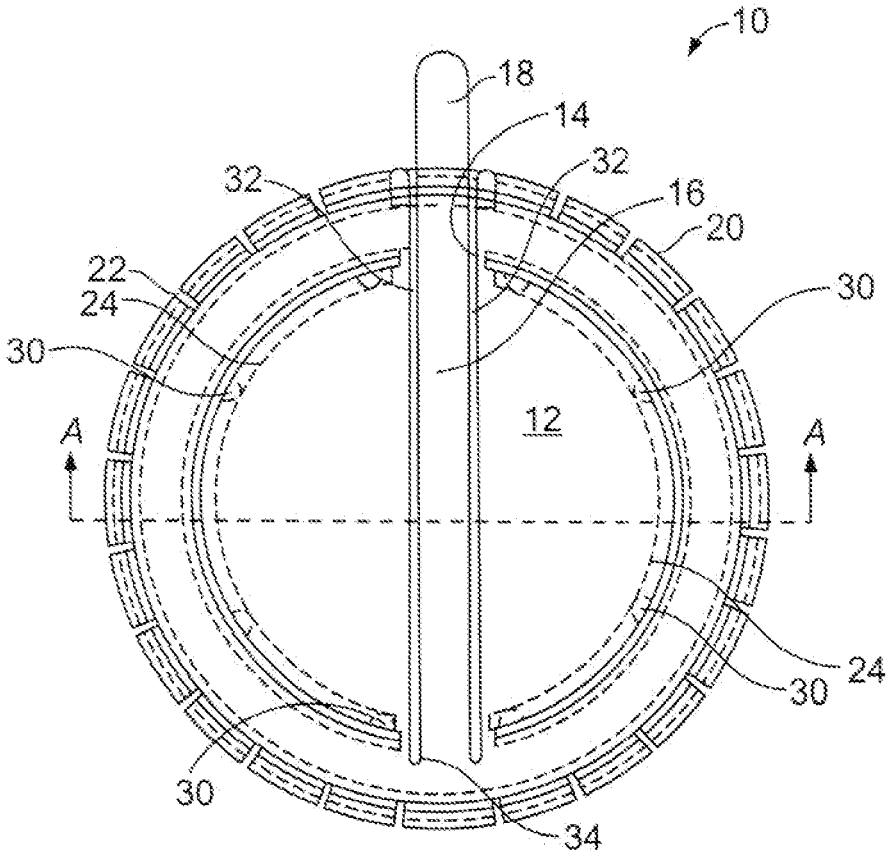
FIG. 1 is a top plan view of an illustrated embodiment of the universal cap seal of the present invention.
Figure 2:
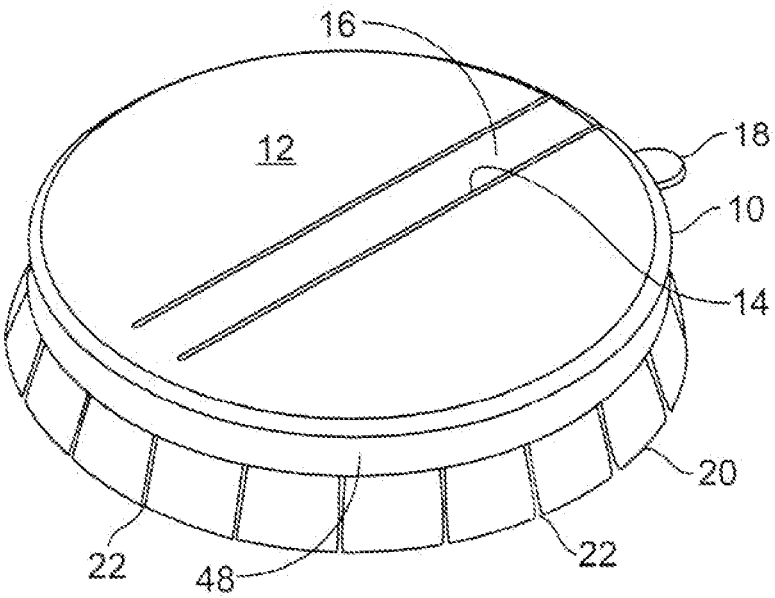
FIG. 2 is a top perspective view of the illustrated embodiment of the universal cap seal of FIG. 1.
Figure 3:
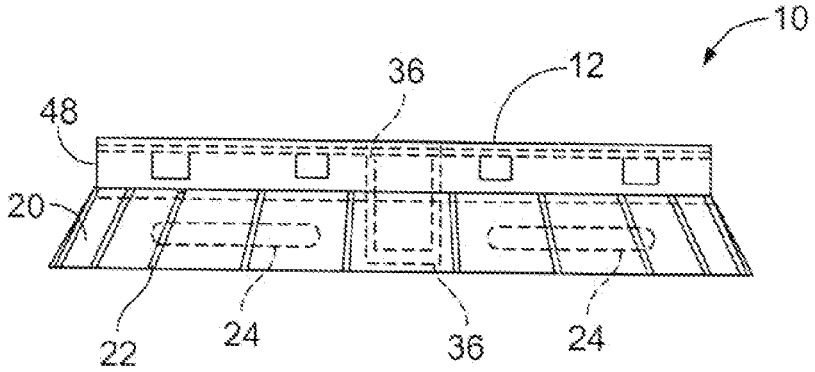
FIG. 3 is a side plan view of the illustrated embodiment of the universal cap seal of the present invention.
Figure 4:
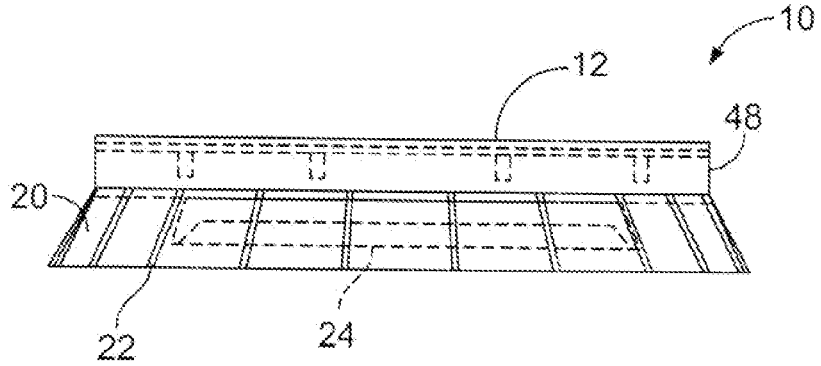
FIG. 4 is another side plan view of the illustrated embodiment of the universal cap seal of the present invention, rotated ninety degrees from the view of FIG. 3.
Figure 5:
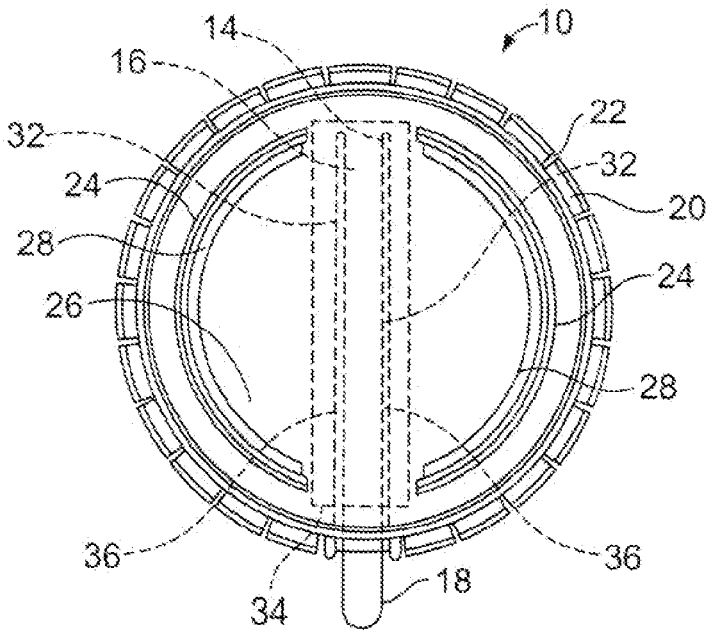
FIG. 5 is a bottom plan view of the illustrated embodiment of the universal cap seal of the present invention.

The universal cap seal for fifty-five gallon drums of an illustrated embodiment of the present invention, shown in FIGS. 1-10, is designed to fit over bung flanges and rims ("B" in FIG. 3) in drums made by different drum manufacturers, with varying size and varying height bung flanges and entrance ports 11. The universal cap seal comprises a body 10 with a flat upper surface 12. A channel 14 in upper surface 12 holds a lifting band 16, shown in FIGS. 1, 2, and 8-10. The band 16 has a lifting tab 18 allowing the user to grasp tab 18, lift band 16, and remove the universal cap seal "A" from the bung flange "B" (FIG. 3).

The body 10 includes a shield 20 extending downward from a rim 48, which shield 20 is divided into a plurality of individual pivotal segments by slits 22, shown in FIGS. 2-4 and 6. Different drum manufacturers of plastic drums 23 use different mold systems, and the slits 22 in shield 20 allow the shield 20 of cap seal body 10 to spread outwardly to work with different height flange/plug systems as the cap is inserted onto flange "B." The flanges "B" of some drums also have protruding mold marks, so the segmented shield 20 of the present invention allows the cap to have certain segments that pivotally flare, while leaving other segments as is.

Figure 6:
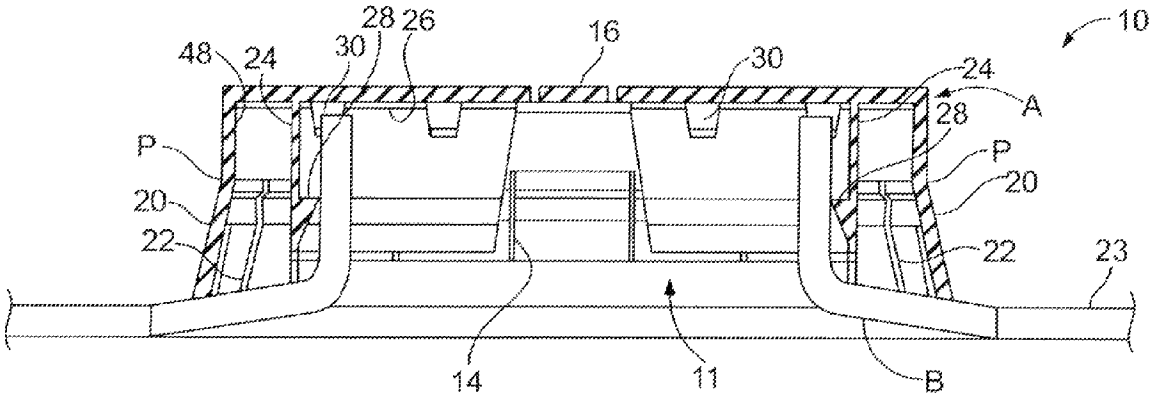
FIG. 6 is a detail side cross-sectional view of the illustrated embodiment of the universal cap seal of the present invention, shown mounted on a filling and emptying aperture flange, taken along line A-A of FIG. 1.
Figure 7:
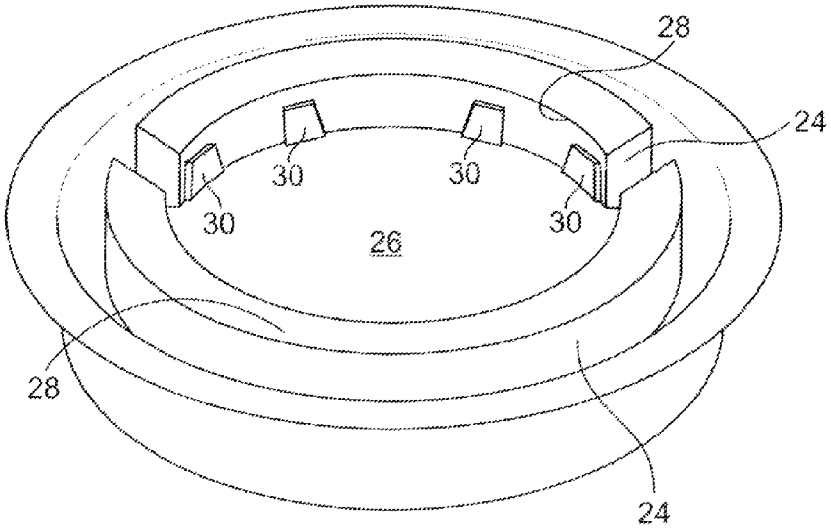
FIG. 7 is a bottom-side perspective view of the illustrated embodiment of the universal cap seal of the present invention.
Figure 8:
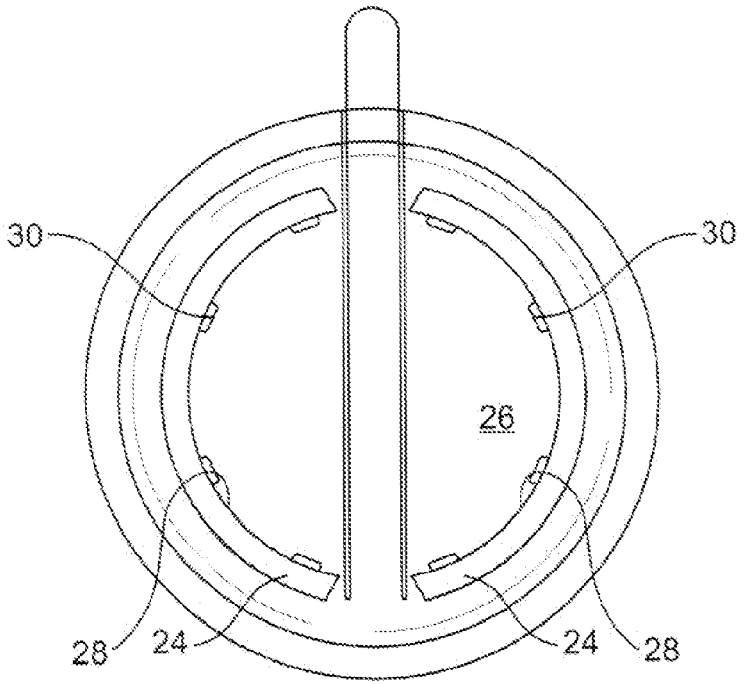
FIG. 8 is a bottom plan view of the illustrated embodiment of the universal cap seal of the present invention.

The body 10 of the cap also includes two internal snap elements 24 that extend downward from the internal surface 26 of body 10, as shown in FIGS. 6-10. In the illustrated embodiment of the universal cap seal of the present invention, each of the two internal snap elements 24 extend circularly approximately 130 degrees, more or less. Each snap element 24 includes a continuous, 130 degree, triangular shaped (in cross section) snap protrusion 28 that is formed or molded as part of each snap element 24. Each snap protrusion 28 frictionally engages an outer portion of flange "B" when the cap seal is inserted over the flange "B," as shown in FIG. 6, to assist in holding the cap seal 10 on the flange "B".

Referring to FIG. 6, when the cap seal body 10 is inserted over flange "B," the segments of shield 20 contact the surface of flange "B," such that the segments of shield 20 are pivoted outward from pivot point "P." The internal resistance to pivoting inherent in the material from which cap seal body 10 and shield 20 segments are made produces an upward force on cap seal 10, which assists in urging snap protrusions 28 into frictional and locking contact with an outer surface portion of flange "B" to complete the locking function by forcing the inward facing tip of each snap protrusion 28 into compressive contact with the surface of flange "B."

Figure 9:
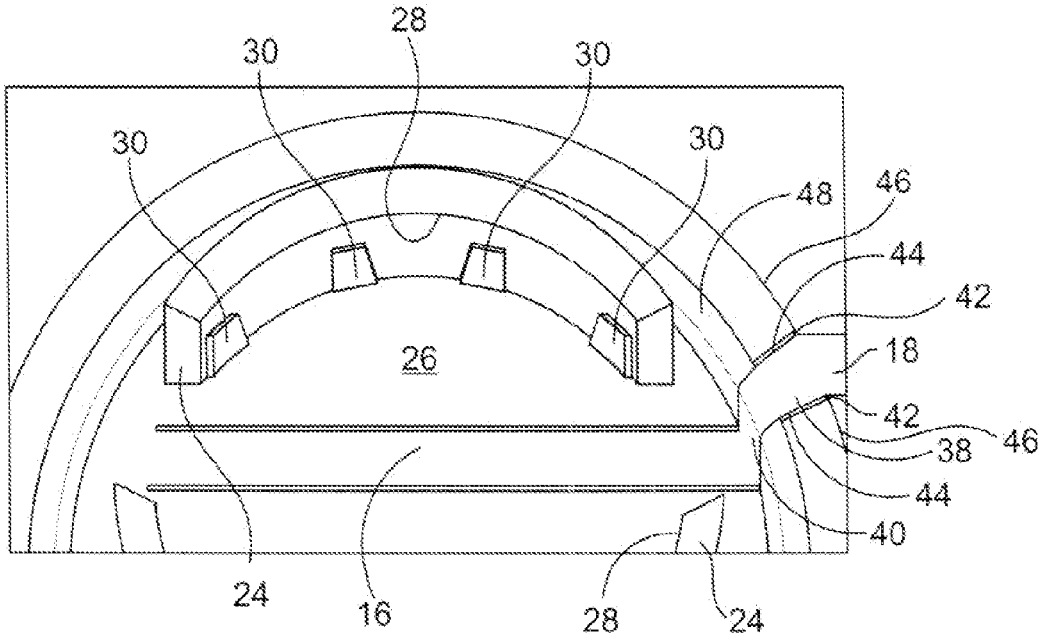
FIG. 9 is a detail bottom perspective view of the illustrated embodiment of the universal cap seal of the present invention.
Figure 10:
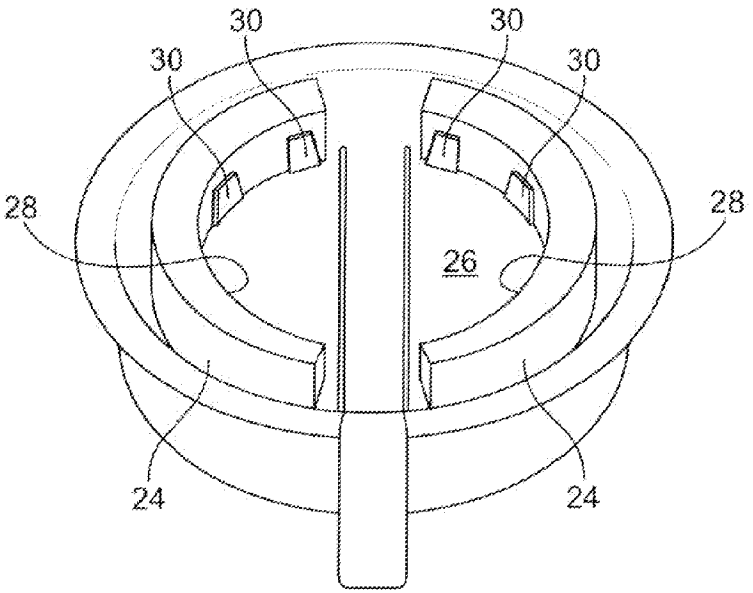
FIG. 10 is a detail bottom-side perspective view of the illustrated embodiment of the universal cap seal of the present invention.

A plurality of centering studs 30 are located on each snap element 24 at the junction of each snap element with the internal surface 26 of cap body 10, and vertically spaced from snap protrusion 28 to accommodate variations in bung flange "B," shown in FIGS. 6, 9, and 10, such that each centering stud engages the upper rim portion of flange "B."

FIG. 6 also illustrates the cap seal "A," when in use, placed over bung flange "B." The upper rim of flange "B" engages the plurality of centering studs 30, and a lower portion of flange "B" engages snap protrusion 28 of each snap element 24. These two axial points of contact hold the cap seal "A" onto flange "B."

Figure 11:
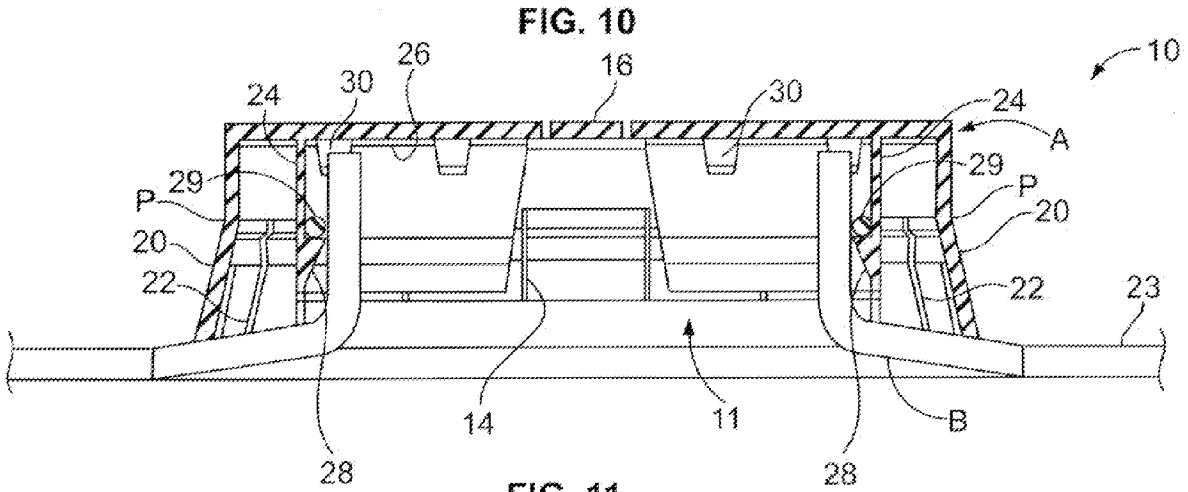
FIG. 11 is a detail side cross-sectional view of the illustrated embodiment of the universal cap seal of the present invention, taken along line A-A of FIG. 1, and showing the cap seal mounted on a flange having a protruding bead circumscribing the flange.

Referring to FIG. 11, some drums have a flange "B" that includes a bead or rib 29. When in use, the cap seal is placed over bung flange "B" where the upper rim of flange "B" engages the plurality of centering studs 30, the bead or rib 29 engages snap protrusion 28, and a lower portion of flange "B" also engages snap protrusion 28 of each snap element 24. These three axial points of contact hold the cap seal "A" onto flange "B."

The cap seal of the present invention also embodies a "tamper evident" feature that will show if the cap seal body has previously been removed, or attempted to be removed from the flange "B" of the drum. Referring to FIGS. 1, 3-5, and 9, a space 32 is formed on both sides of lifting band 16 in channel 14, and one end 34 of lifting band 16 is attached to upper surface 12 of cap seal body 10, whereby lifting band 16 can pivot at end 34 when lifting tab 18 is manually gripped and moved upward. A thin film 36 of the material from which cap seal 10 is manufactured, or a separate film of thin material, extends across each space 32, and frangibly attaches lifting band 16 to flat upper surface 12. If an upward force is applied to lifting tab 18, the frangible thin film 36 breaks as the lifting band 16 detaches from upper surface 12 of cap seal body 10. If the lifting band 16 is replaced in channel 14 (FIG. 2), an observer would see that the thin film 36 is missing from spaces 32, signaling that the cap seal body 10 has been tampered with.

A further feature of the tamper evident capabilities of the present invention are illustrated in FIG. 9, where lifting tab 18 includes a slanted portion 38 extending between lifting tab 18 and a vertical portion 40 of lifting band 16. A pair of spaces 42 are provided on each lateral side of slanted portion 38, and a thin portion of frangible material 44 is located in each space 42 to frangibly connect slanted portion 38 with outwardly extending narrow strips 46 of shield 20. Frangible material 44 also frangibly connects vertical portion 40 of lifting band 16 to downwardly extending rim 48 of the cap seal body 10.

With the application of an upward manual force to lifting tab 18, as seen in FIG. 9, the frangible material between slanted portion 38 and narrow strips 46 of shield 20 breaks. The frangible material 44 between vertical portion 40 and rim 48 also breaks as lifting tab 18 is moved further to raise the lifting band 16. If lifting band 16 is replaced in channel 14, the frangible material 44 will be broken, signaling an observer that cap seal body 10 has been tampered with.

The foregoing description of an illustrated embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

What is claimed is:

1. A cap seal for insertion over a flange of an entrance port communicating with the interior of a container, the entrance port defined by the flange attached to an outer portion of the container, the cap seal comprising:

a. a body having a flat upper surface and an internal surface;

b. a sidewall extending from said flat upper surface;

c. a shield extending downwardly from said sidewall, said shield having a plurality of individual pivotal segments separated by a plurality of slits; and d. at least two internal snap elements extending downwardly from said internal surface, said at least two internal snap elements each including an independent integrally formed continuous snap protrusion, said at least two internal snap elements and each of said independent integrally formed continuous snap protrusion adapted to frictionally engage an outer portion of the flange.

2. The cap seal of claim 1, wherein the flat upper surface further comprises a channel having a lifting band and a lifting tab, said lifting tab adapted to facilitate removal of the cap seal from the flange.

3. The cap seal of claim 1, wherein the at least two internal snap elements extend at least 120 degrees.

4. The cap seal of claim 2, wherein the lifting band is frangibly connected to a portion of the flat upper surface extending on either side of said channel, said frangible material permanently breaking when said lifting band is removed from said channel to facilitate removal of the cap seal from the flange.

5. A cap seal for insertion over a flange of an entrance port communicating with the interior of a container, the entrance port defined by the flange attached to an outer portion of the container, the cap seal comprising:

a. a body having a flat upper surface and an internal surface;

b. a sidewall extending from said flat upper surface;

c. a shield extending downwardly from said sidewall, said shield having a plurality of individual pivotal segments separated by a plurality of slits;

d. at least two internal snap elements extending downwardly from said internal surface, said at least two internal snap elements each including at least one independent integrally formed continuous snap protrusion, said at least two internal snap elements and each of said at least one independent integrally formed continuous snap protrusion adapted to frictionally engage an outer portion of the flange; and e. a plurality of centering studs on the at least two internal snap elements vertically opposite each snap protrusion, said plurality of centering studs adapted to engage an upper rim of the flange.

6. The cap seal of claim 5, wherein the snap protrusion is triangular shaped in cross section.

7. The cap seal of claim 5, wherein the snap protrusion extends at least 120 degrees.

8. The cap seal of claim 5, wherein the snap protrusion of each snap element engages a lower portion of the flange.

9. The cap seal of claim 5, wherein certain of the pivotal shield segments engage an outer portion of the flange when the cap seal is placed over the flange, said certain pivotal shield segments applying a force on the cap seal, which force is adapted to urge said continuous snap protrusions into frictional contact with said flange.

10. The cap seal of claim 5, wherein an outer portion of the flange includes at least one integrally formed continuous bead, said continuous snap protrusion is adapted to engage said continuous bead when said cap seal is placed over said flange.

11. A cap seal for insertion over a flange of an entrance port communicating with the interior of a container, the entrance port defined by the flange attached to an outer portion of the container, the cap seal comprising:

a. a body having a flat upper surface and an internal surface;

b. a sidewall extending from said flat upper surface;

c. a shield extending downwardly from said sidewall, said shield having a plurality of individual pivotal segments separated by a plurality of slits;

d. at least two internal snap elements extending downwardly from said internal surface, said at least two internal snap elements each including at least one integrally formed continuous snap protrusion, said at least two internal snap elements and each of said at least one independent integrally formed continuous snap protrusion adapted to frictionally engage an outer portion of the flange; and e. a plurality of centering studs on the at least two internal snap elements vertically opposite each snap protrusion, said plurality of centering studs adapted to engage an upper rim of the flange.

* * * * *